US008225753B2

(12) United States Patent
Sorrels

(10) Patent No.: US 8,225,753 B2
(45) Date of Patent: Jul. 24, 2012

(54) SORRELS ENGINE

(76) Inventor: Joe Mark Sorrels, Russellville, AR (US)

( * ) Notice: Subject to any disclaimer, the term of this patent is extended or adjusted under 35 U.S.C. 154(b) by 729 days.

(21) Appl. No.: 12/378,569

(22) Filed: Feb. 17, 2009

(65) Prior Publication Data

US 2009/0194071 A1 Aug. 6, 2009

Related U.S. Application Data

(63) Continuation-in-part of application No. 11/580,615, filed on Oct. 12, 2006, now abandoned.

(51) Int. Cl.
*F01B 13/04* (2006.01)

(52) U.S. Cl. ..... 123/43 R; 123/44 C; 123/54.3

(58) Field of Classification Search ..... 123/43 R, 123/44 C, 44 D, 45 R, 54.3
See application file for complete search history.

(56) References Cited

U.S. PATENT DOCUMENTS 3,499,424 A * 3/1970 Rich ..... 123/44 D
3,931,809 A * 1/1976 Corte et al. ..... 123/43 R
4,010,719 A * 3/1977 Lappa ..... 123/44 C
4,078,529 A * 3/1978 Warwick ..... 123/44 C
4,377,136 A * 3/1983 Evans ..... 123/44 C
4,836,149 A * 6/1989 Newbold ..... 123/44 R
5,636,599 A * 6/1997 Russell ..... 123/44 B
5,720,241 A * 2/1998 Gail ..... 123/44 C
5,758,609 A * 6/1998 Smith ..... 123/44 R
7,353,784 B2 * 4/2008 Nicholson, IV ..... 123/43 R
2007/0137595 A1 * 6/2007 Greenwell ..... 123/43 R

* cited by examiner

*Primary Examiner* — Noah Kamen
*Assistant Examiner* — Hung Q Nguyen

(57) ABSTRACT

An internal combustion engine of uniquely simple elements that combines the use of an assemblage of rotating elements to restrain cylinders radically coplanar perpendicular to centerline of the power shaft and pistons and connecting rods to a rotating coplanar reciprocating alignment with the cylinders, channels to force strokes of the pistons and connecting rods, with the energy of the power stroke and the resistance of the same by the channels producing a force that rotates the assemblage inside a ported engine housing. Engine should be lighter, able to use a variety of fuels, able to use simplified ignition systems, produce more power and be more cost efficient to manufacture and operate than existing engines of the same displacement. Once engine position and fuel is decided elements of the fuel, cooling, lubrication, ignition and electrical systems can be included in the drawings.

9 Claims, 7 Drawing Sheets

*Fig. No. 1*
*locations of sections*
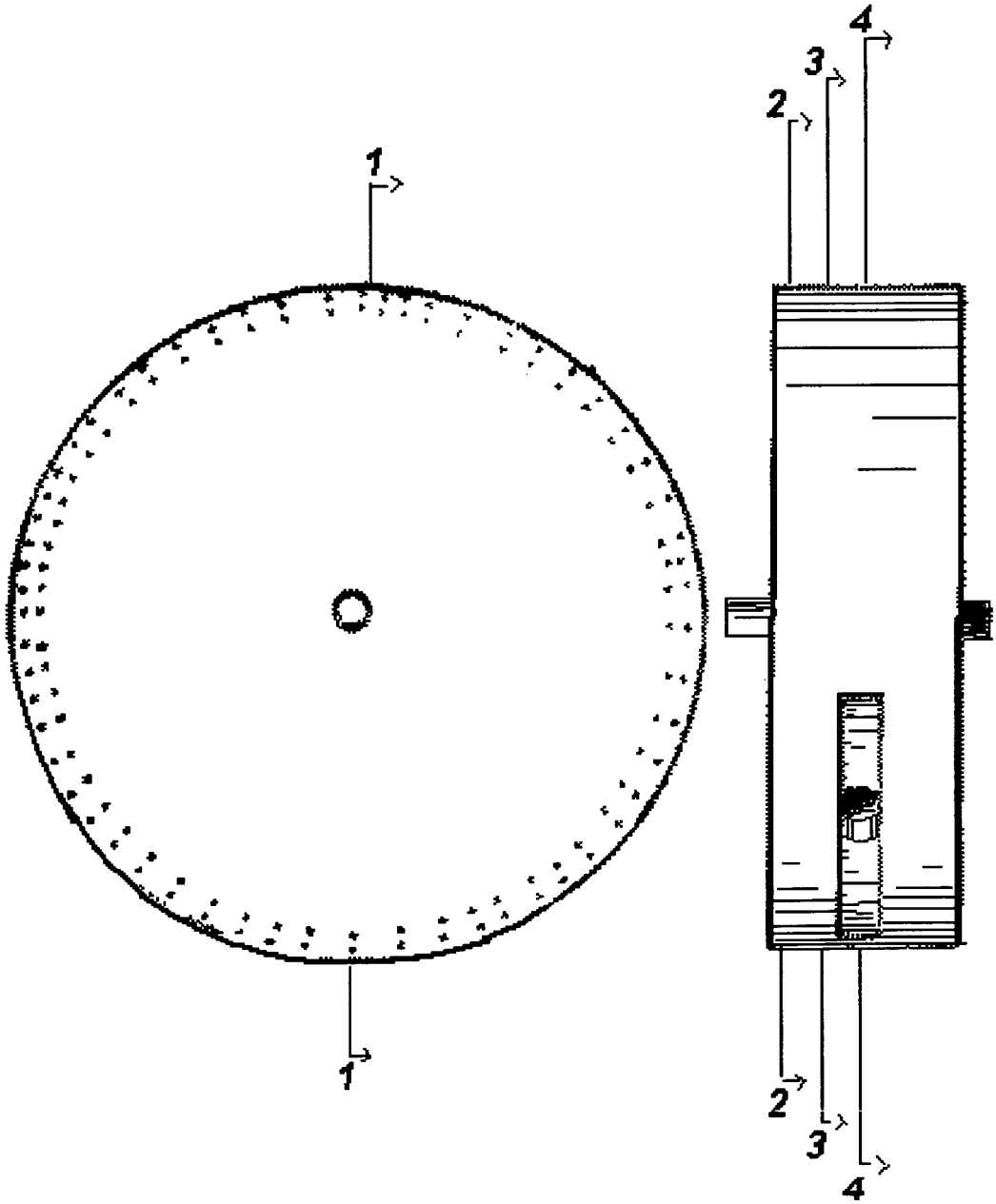

*Fig. No. 2A*
*section 1-1*
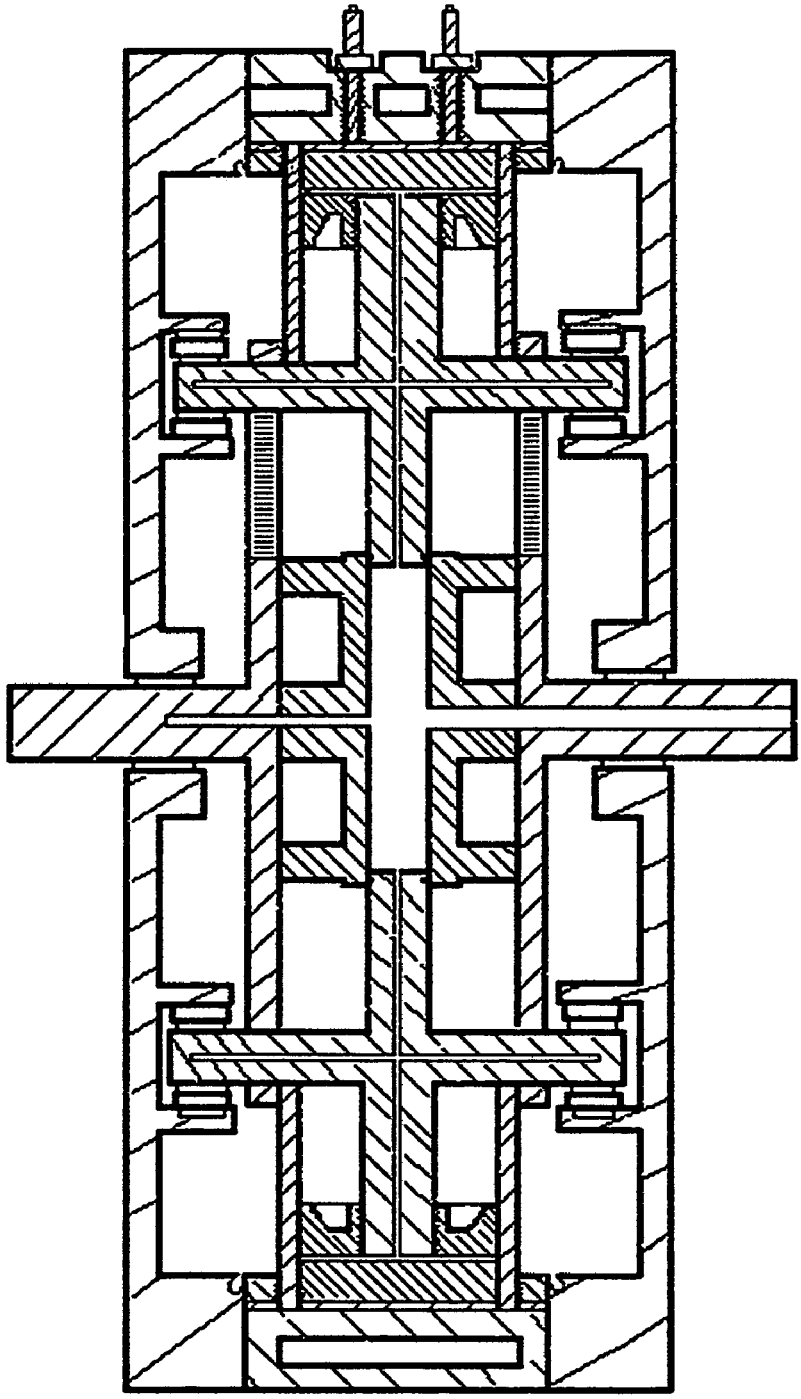

*Fig. No. 2B*
*section 1-1*
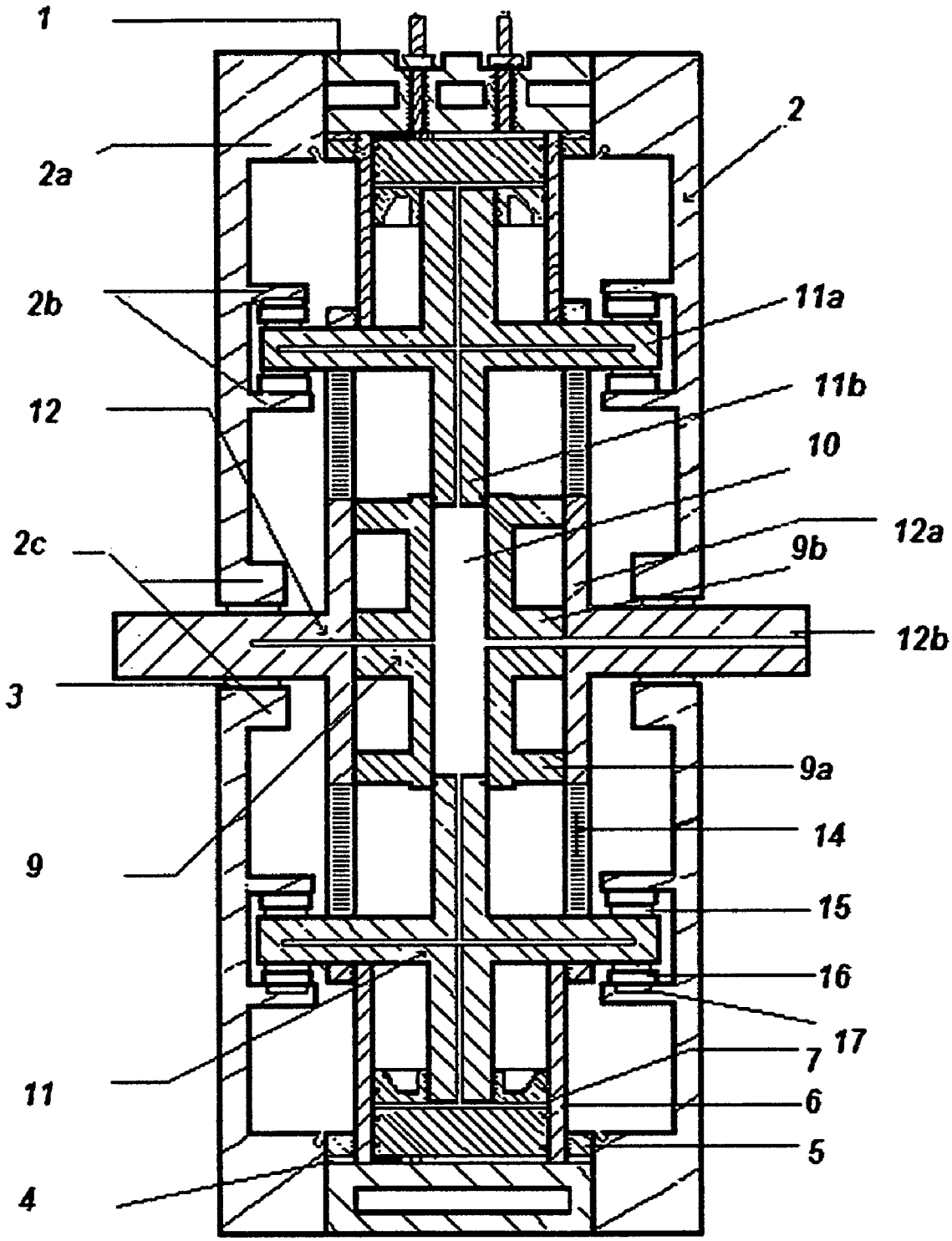

Fig. No. 3
section 2-2
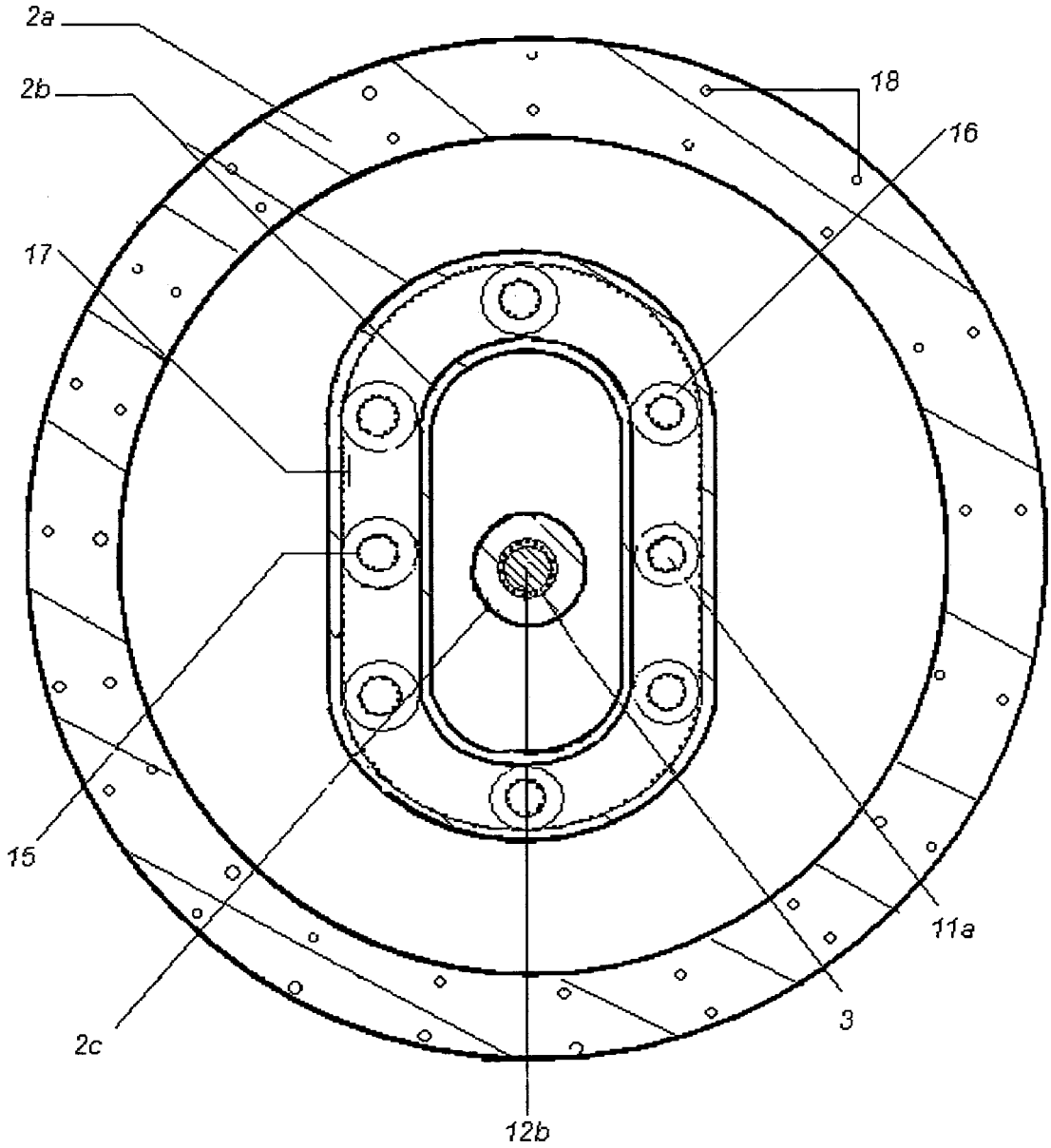

Fig. No. 4
section 3-3
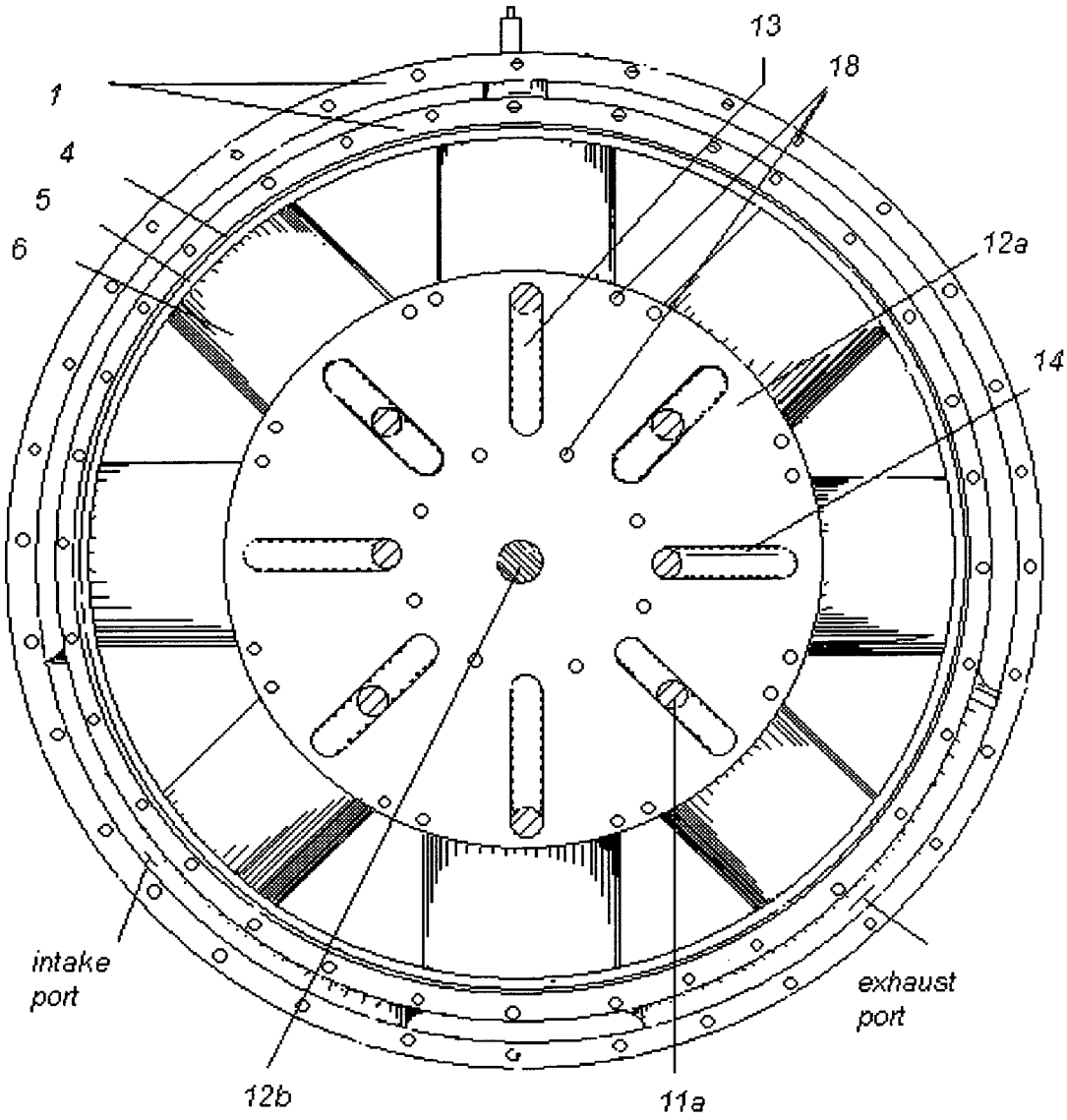

*Fig. No. 5A*
*section 4-4*
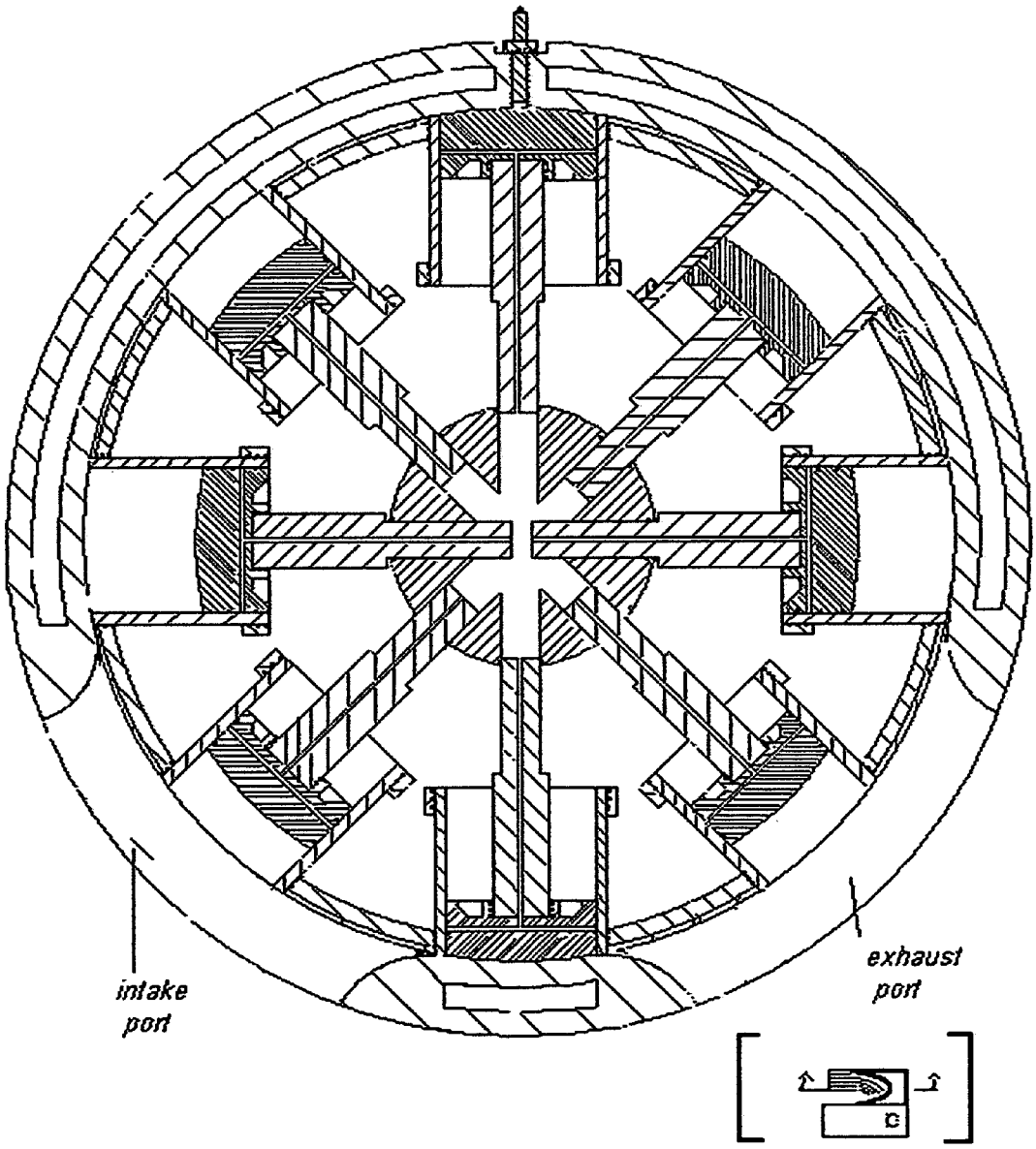

*Fig. No. 5B*
*section 4-4*
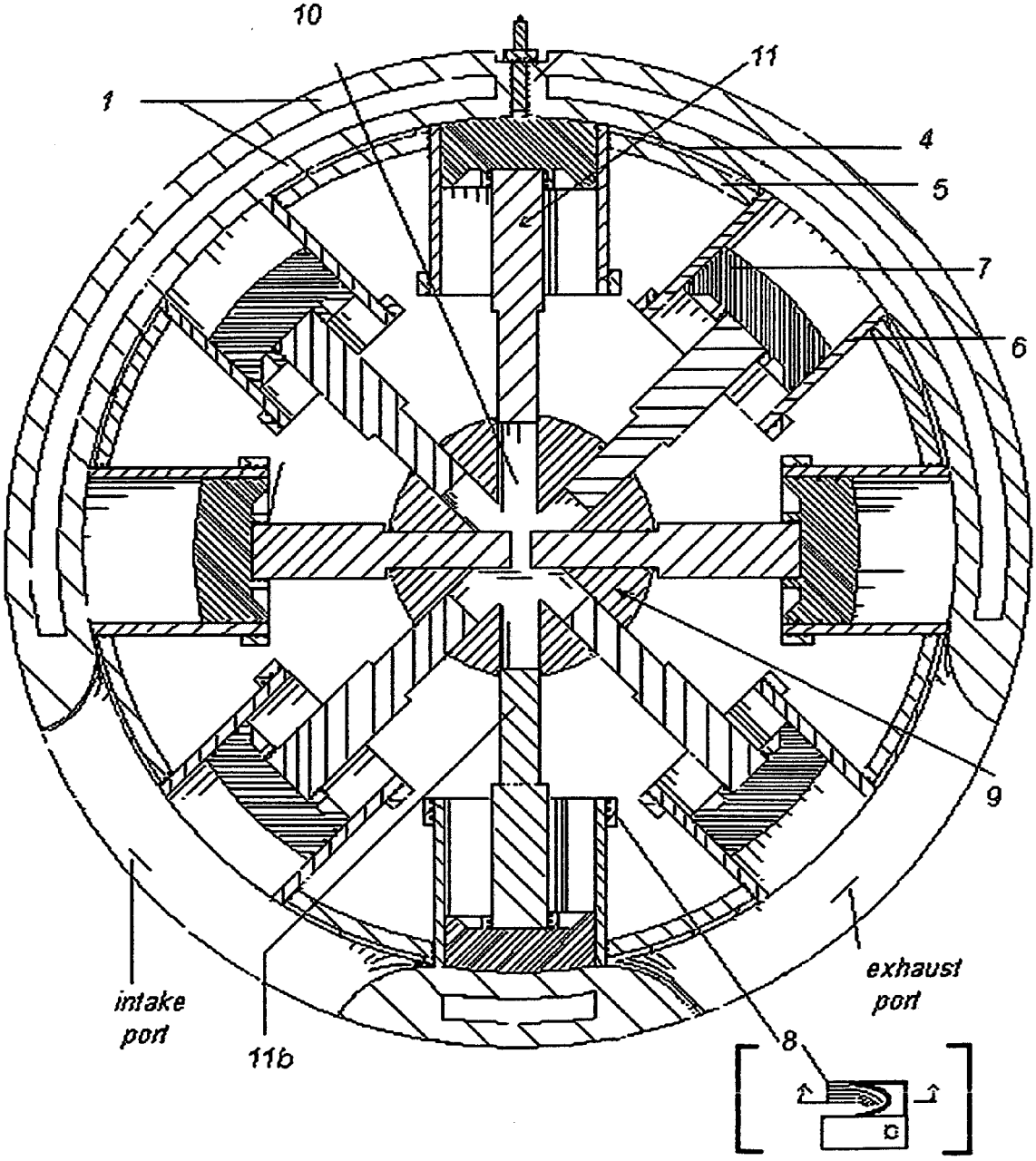

SORRELS ENGINE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

Same as typical for existing four and two cycle engines.

U.S. CL . . . 123/44C; 123/44D; 123/45R; 123/54.3

2. Background Art

Existing four cycle engines utilize crankshafts that provide little mechanical advantage, have restricted intake and exhaust cycles, existing four cycle engines must store energy in flywheels to smooth power strokes, existing four cycle engines can provide only one power stroke per cylinder every other revolution and have strokes that are limited to each being ninety degrees of revolution. Two cycle engines are polluters.

Attempts at designing rotary engines with some, most or all of the following elements; reciprocating pistons, rotating cylinders, cams and ported engine housings, have failed to produce marketable designs because they would not produce the amount power required, have much concentric motion, were limited to strokes of ninety degrees in duration, were suitable only for aircraft, were too complex or could not be properly cooled or lubricated, or could not be practically manufactured.

| U.S. Patents | | |
|---|---|---|
| 802,033 | Raoul Philippe | Apr. 30, 1907 |
| 1,190,949 | Raoul Philippe | Jun. 11, 1916 |
| 1,613,528 | H. A. PALMER | Aug. 25, 1925 |
| 1,798,104 | H. A. PALMER | Oct. 7, 1927 |
| 2,242,231 | H. D. Cantoni | Feb. 11, 1941 |
| 2,265,171 | N. L. JOHNSON | Mar. 13, 1939 |
| 3,967,599 | Ray T. Townson | Jul. 6, 1976 |
| 4,038,949 | Victor W. Farris | Aug. 2, 1977 |
| 4,300,487 | Joseph P. Triulzi | Aug. 4, 1980 |
| 4,653,438 | Robert L. Russell | Mar. 31, 1987 |
| 4,836,149 | Vermon D. Newborn | Apr. 7, 1988 |
| 6,167,850 | David H. Bount | Feb. 2, 2001 |

BRIEF SUMMARY OF THE INVENTION

In this engine the resultant of the power stroke and resistance to the same by channels cast in the engine housings forces rotation of an upper restraining ring, pistons with rings, cylinders, channel rollers, slotted restraining plates with power shafts, connecting rods with side shafts, restraining hub and threaded spacer bars. Cylinders rotate past exhaust and intake ports in the cylinder head while channel rollers in the channels force the cycles. Engine provides a minimum of one power stroke for every cylinder every revolution with unrestricted exhaust and intake strokes. A large percentage of the mass of the engine is rotating. The advantage of this engine is no flywheel is required, complete unrestricted exhaust and intake cycles, a minimum of one power stroke every cylinder every revolution, variability in the duration of stokes, fuel efficiency, and simplified manufacturing and it produces more power relative to its weight and displacement.

BRIEF DESCRIPTION OF THE SEVERAL VIEWS OF THE DRAWINGS

FIG. 1 shows the location of the cross sectional views

FIG. 2A shows sectional view number 1-1, refer to FIG. 2B

FIG. 2B assigns reference numbers to FIG. 2As' elements as follows

| ref. no. | description |
|---|---|
| 1 | Cylinder head (includes intake and exhaust ports) |
| 2 | Engine housing with channel |
| 2a | Thickened peripheral portion (of engine housing with channel) |
| 2b | Channel portion (of engine housing with channel) |
| 2c | Circular center thickening (of engine housing with channel) |
| 3 | Power shaft bearings |
| 4 | Seal and compression rings |
| 5 | Upper restraining ring (includes threaded Cylinder openings) |
| 6 | Cylinders (includes threads at opposing ends) |
| 7 | Piston with rings (with threaded connecting rod opening) |
| 9 | Restraining hub |
| 9a | Peripheral thickening (of the restraining hub) |
| 9b | Circular center thickening (of the restraining hub) |
| 10 | Receiving cylinders |
| 11 | Connecting rod with side shafts (includes threads to attach piston) |
| 11a | Side shaft portion (of connecting rod with side shafts) |
| 11b | Inwardly end (of connecting rod with side shafts) |
| 12 | Slotted restraining plate with power shaft |
| 12a | Plate portion (of slotted restraining plate with power shaft) |
| 12b | Power shaft portion (of slotted restrain plate with power shaft ) |
| 14 | Restraining plate slot bearings |
| 15 | Channel roller bearings |
| 16 | Channel rollers |
| 17 | Channel bearings |

FIGS. 3, 4 and 5B assigns reference numbers to the elements as follows

| | |
|---|---|
| 8 | Threaded spacer bars |
| 13 | Restraining slots |
| 18 | Threaded holes with fastener |

FIG. 3 Shows sectional view numbers 2-2; refer to ref. no's 2*a*, 2*b*, 2*c*, 3, 11*a*, 12*a*, 12*b*, 15, 16, 17 and 18 reveling only thicken and channel portions of an engine housing with channels.

FIG. 4 Shows sectional view number 3-3, refer to ref. no's 1, 4, 5, 6, 11*a*, 12*a*, 12*b*, 13, 14 and 18 showing how connecting rods side shafts extend through restraining slots in a slotted restraining plate with power shaft.

FIG. 5A Shows sectional view number 4-4, refer to ref. no's 1, 4, 5, 6, 7, 9, 11, and 11*b*, a longitudinal section through the center of the engine; showing how connecting rods are restrained by restraining hub, showing exhaust and intake ports, showing cylinder and piston alignment and showing threaded spacer bars.

FIG. 5B Assigns reference no's to FIG. 5As' elements and has a bracketed view of element reference number 8.

DETAILED DESCRIPTION OF THE INVENTION

Fuel systems are not addressed in this application due to the wide variance of fuels available and the need to adapt these systems to the fuels properties.

Cooling systems are not addressed in this application due to the wide variance of fuels available and need to adapt these systems to the fuels properties.

Lubrication systems are not addressed in this application due to the wide variance of fuel available and the need to adapt these systems to the fuels properties.

Ignition and electrical systems are not addressed in this application due to the wide variance of fuel available and the need to adapt these systems to the fuels properties.

Elements of the above systems, subdivision of multifunctional elements and minor changes to the elements are not limited by this description or the claims.

A rotary four-cycle internal combustion engine that is an assemblage of single and multifunctional fixed elements comprising a cylinder head 1 (FIGS. 2B, 4 and 5B) being cylindrical with a singularity or plurality of exhaust and a singularity or plurality of intake ports serially located around the peripheral in correspondence with engines exhaust and intake cycles prescribed by the channel portions 2*b*, a duality of engine housings with channels 2 (FIG. 2B), circular plates having thickened peripheral portions 2*a* providing space for parallel protrusions extended inward forming channel portions 2*b* and circular center thickening 2*c* extended inward, with material removed from circular center thickening 2*c* forming openings for power shafts, providing space for placement of power shaft bearings 3 and fastened along the peripheries opposing one another with protrusions facing inwardly to a cylinder head 1, and an assemblage of single and multifunctional rotating elements comprising a duality of power shaft bearings 3 (FIGS. 2B and 3) disposed in circular center thickening 2*c* of a duality of opposing engine housings with channels 2, a seal and compression rings 4 (FIGS. 2B, 4 and 5B), cylindrical with openings equal in diameter to the inside diameter of a cylinder 6 evenly coplanar radially disposed, aligned with and against the inwardly surface of a cylinder head 1 providing closure of exhaust and intake ports when a cylinder 6 is not present and tighter seal of the cylinders during compression and combustion cycles, an upper restraining ring 5 (FIGS. 2B, 4 and 5B), cylindrical with a plurality of threaded openings for a plurality of cylinders 6 evenly coplanar radially disposed, aligned with and against the inside surface of a seal with compression rings 4, a plurality of cylinders 6 (FIGS. 2B, 4 and 5B) evenly coplanar radially disposed with the outward end against a seal and compression rings 4 and extending inwardly, threaded at opposing ends with cylinders 6 slightly, greater in outside diameter for the length of the threads on the outward ends, and fastened in threaded openings in a upper restraining ring 5, a plurality of pistons with rings 7 (FIGS. 2B and 5B) reciprocally disposed in each cylinder 6 and aligned for a singularity or plurality of pistons 7 to be in each of the four cycle regions simultaneously, a plurality of threaded spacer bars 8 (FIG. 5B) evenly coplanar radially disposed in pairs joining each other forming rectangles with threaded cylinders and rigidly fastened to the inward ends of cylinders 6, a restraining hub 9 (FIGS. 2B and 5B) being a thick circular plate having peripheral 9*a* and circular center thickening 9*b* extending outwardly in opposing directions and having receiving cylinders 10 evenly coplanar radially disposed from its center, a plurality of connecting rods with side shafts 11 (FIGS. 2B, 3, 4 and 5B) fastened to a plurality of pistons 7 with rings radially reciprocally disposed in each cylinder 6, having side shaft portions 11*a* extended transversely and having the inwardly ends 11*b* reciprocally disposed in each receiving cylinder 10 of a restraining hub 9, a duality of slotted restraining plates with power shafts 12 (FIGS. 2B, 3, 4 and 5B) having circular plate portions 12*a* with restraining slots 13 evenly coplanar radially disposed and having power shafts portions 12*b* extending transversely in one direction from the centers of the plate portions 12*a*, a plurality of restraining plate slot bearings 14 (FIGS. 2B and 4) evenly disposed opposing one another in restraining slots 13 reducing friction between reciprocating side shafts 11*a* and sides of restraining slots 13, a plurality of channel roller bearings 15 (FIGS. 2B and 3) fastened to the side shafts portions 11*a*, a plurality of channel rollers 16 (FIGS. 2B and 3) fastened to, with channel roller bearings 15 between, side shaft portions 11*a* and fitted within channel portions 2*b*, a plurality of channel bearings 17 (FIGS. 2B and 3) evenly disposed along outward side of channel portions 2*b* reducing resistance to rolling motion of channel rollers 16 and a plurality of threaded holes with fasteners 18 (FIGS. 3 and 4) to assemble the elements.

An engine having engine housings with channels 2 fastened to cylinder head 1, with thickened 2*a* and 2*c* and channel portions 2*b* turned inwardly, inclosing all rotating elements excepting an outwardly portion of power shaft portions 12*b*, having channel portions 2*b* with a center line alignment two stoke lengths plus half the diameter of side shaft portions 11*a* from axis of rotation at beginning of combustion and intake cycles and a stoke length plus half the diameter of side shaft portions 11*a* from axis of rotation at beginning of compression and exhaust cycles and with degrees of each rotation between the cycles, as drawn, being ninety, having channel portions 2*b* concentrically resisting inwardly forces applied to channel rollers 16 during combustion cycles forcing channel rollers 16 to roll within channel portions 2*b* alignment transitioning inwardly a stroke length,

- outwardly resisting motion of channel rollers 16 as channel portions 2*b* alignment transitions outwardly a stroke length during exhaust cycles,
- inwardly resisting channel rollers 16 motion as channel portions 2*b* alignment transitions inwardly a stroke length during intake cycles,
- outwardly resisting channel rollers 16 motion as channel portions 2*b* alignment transitions outwardly a stroke length during compression cycles,
- with stroke length, degrees of rotation between cycles and number of cycles being those, within practicalities of dimension and mechanics, best suiting chosen fuel.

An engine having a cylinder head 1 providing a surface to seal top of a cylinder 6 during compression and combustion cycles, providing access to cylinders 6 by ignition and/or fuel injection devises and a singularity or plurality each, beginning at beginning and ending at end of exhaust and intake cycles, of exhaust and intake ports serially located in correspondence with cycles prescribed by alignment of channel portions 2*b*.

An engine having an assemblage of rotating elements consisting of an upper restraining ring 5, a seal and compression rings 4, a plurality of cylinders 6, a plurality of threaded spacer bars 8, a restraining hub 9, a plurality of receiving cylinders 10, a plurality of restraining slots 13, and a duality of slotted restraining plates with power shafts 12 fastened together in rigid parallel plane radial coaxial alignment and a plurality of pistons 7, a plurality of connecting rods with side shafts 11, a plurality of channel roller bearings 15 and a plurality of channel rollers 16 in parallel plane radially reciprocating coaxial alignment and having cylinders 6 participating in a cycle and disposed for sequential entry into each cycle, pistons with rings 7 reciprocally disposed in cylinders 6, connecting rods with side shafts 11 attached to pistons with rings 7, with side shafts portions 11*a* passed through and restrained in restraining slots 13, attached to channel rollers 16 disposed in channel portions 2*b* and lower portions lib disposed in receiving cylinders.

An engine having an upper restraining ring 5 with outward ends of cylinders 6 fastened into threaded openings restraining cylinders in spaced apart coplanar radial coaxial alignment extended inwardly and having a seal with compression rings 4 between inward surface of cylinder head 1 and upper restraining rings 5 outward surface closing ports when cylinders are not present and providing tighter seal of cylinders during compression and combustion cycles.

An engine having a plurality of cylinders 6 threaded at opposing ends with cylinders 6 slightly greater in outside diameter for length of threads on outward ends, fastened into threaded openings in upper restraining ring 5 and fastened into joined pairs of threaded spacer bars 8 at inward ends providing a rigid coplanar coaxial connection between upper restraining ring 5 and threaded spacer bars 8.

An engine having a plurality of pistons with rings 7 reciprocally disposed in each cylinder 6 and aligned for a singularity or plurality of pistons 7 to be in each of the four cycle regions simultaneously and disposed for sequential entry into each cycle region, An engine having a plurality of threaded spacer bars 8 evenly radically coplanar disposed and fastened between opposing plate portions 12*a*, spacing plate portions 12*a* apart equal to outside diameter of inward end of cylinders 6 fastened to and restraining a plurality of cylinders 6 in coplanar evenly spaced radially coplanar coaxial; alignment, An engine having a restraining hub 9 fastened between and spacing apart, equal to the outside diameter of inward end of cylinders 6, opposing plate portions 12*a* and restraining receiving cylinders 10 and inwardly ends 11*b* in evenly spaced parallel plane radial alignment, An engine having slotted restraining plates with power shafts 12 restraining side shaft portions 11*a* passed through restraining slots 13 in evenly spaced parallel plane radial reciprocating alignment, restraining joined pairs of threaded spacer bars 8, restraining slots 13 of opposing plate portions 12*a* and restraining hub 9 in evenly spaced parallel plane radial coaxial alignment, having transversely offset from centers of plate portions 12*a* opposing power shaft portions 12*b*, extending through opposing power shaft bearings 3 and openings in opposing thickened circular center portions 2*c*, providing an axes of rotation for an assemblage of single and multifunctional rotating elements.

An engine having a plurality of connecting rods with side shafts 11 fastened to pistons with rings 7, channel roller bearings 15 and channel rollers 16 forcing fastened elements to reciprocate in unison, transferring pressure of expanding combustion gases acting as an inward force on piston with rings 7 during combustion cycle to channel rollers 16 constrained within channel portions 2*b* transitioning a stoke length closer to axis of rotation, where force is concentrically resisted forcing channel rollers 16 engaged in combustion cycles to roll applying force to fastened side shafts 11*a* which in return is applied to sides of slots 13 inducing rotational momentum to slotted restraining plates with power shafts and fastened elements which in return is applied to side shaft portions extended though slots engaged in the remaining three cycles, transferring force to channel rollers, which in return transfer the resisting forces constraining channel rollers 16 to alignment of channel portions 2*b* transitioning a stoke length more distant from the axis of rotation during exhaust cycle to pistons with rings 7 pushing pistons with rings 7 outwardly and pushing combustion gases out though an exhaust port, transferring resisting forces constraining channel rollers 16 to alignment of channel portions 2*b* transitioning a stoke length closer to axis of rotation during intake cycle to pistons with rings 7 pulling pistons with rings 7 inwardly in-taking air or fuel/air mixture, and transferring resisting forces constraining channel rollers 16 to alignment of channel portions 2*b* transitioning a stoke length more distant from axis of rotation during compression cycle to pistons with rings 7 pushing pistons with rings 7 outwardly compressing air or fuel/air mixtures.

I claim:

1. A rotary four cycle internal combustion engine having an assemblage of single and multifunctional fixed elements comprising:

a cylindrical cylinder head, with a singularity or plurality of exhaust and a singularity or plurality of intake ports serially located around the peripheral thereof; and a duality of opposing engine housings with channels, wherein said engine housing comprises circular plates thickened along the peripherals extending inwardly to provide space for parallel protrusions extending inwardly that form channel portions, having a circular thickening of the center portions of the plates extending inwardly along a rotational axis of said rotary engine for placement of power shaft bearings, wherein material are removed from said thickened circular center portions to provide openings for power shafts and fastened along the peripheries, opposing one another with protrusions facing inwardly, to said cylinder head and said assemblage of single and multifunctional rotating elements comprising;

a duality of said power shaft bearings disposed in said thickened circular portions of said duality of opposing engine housings with said channels, a seal and compression rings, wherein said seal and compression rings are cylindrical with openings equal in diameter to an inside diameter of a cylinder evenly coplanar radially disposed aligned with and against an inside of said cylinder head, an upper cylindrical restraining ring, with a plurality of threaded openings for a plurality of said cylinders evenly coplanar radially disposed and aligned with and against an inside surface of said seal and compression rings, a plurality of said cylinders evenly coplanar radially disposed with an outward end portion thereof in against said seal and compression rings and extending inwardly with respect said seal and compression rings, a plurality of pistons with rings reciprocally disposed in each cylinder with the cylinders aligned for a singularity or plurality of pistons to be in each of the four cycle regions simultaneously, a plurality of threaded spacer bars evenly coplanar radially disposed in pairs, joining each other to form rectangles with threaded cylinders, rigidly fastened to the inward end of said plurality of cylinders, a restraining hub, wherein said restraining hub is a thick circular plate having peripheral and circular center portion thickening extending outwardly in opposing directions and receiving cylinders evenly coplanar radially disposed from its center, a plurality of connecting rods with side shafts extending parallel to the rotational axis, wherein said connecting rods are fastened to said plurality of pistons with rings radially reciprocally disposed in each cylinder having side shaft portions extended transversely reciprocally disposed through restraining slots and having the inwardly ends reciprocally disposed in each said of receiving cylinder of said restraining hub, a duality of slotted restraining plates with power shafts, circular plates having material removed to form coplanar, radial evenly disposed slots, having power shafts portions extending transversely in one direction from the centers of the plate portions, having said side shaft portions of connecting rods with said side shafts extending through the slots of opposing plate portions, having threaded spacer bars fastened to cylinders and evenly radially aligned with the slots fastened along the inward periphery of opposing plate portions, having said restraining hub with its receiving cylinders radially aligned with the slots and centered with plate portions fastened centered between said opposing plate portions with opposing shaft portions extended through the power shaft bearings and openings in said opposing engine housings with said channels, a plurality of restraining plate slot bearings evenly disposed opposing one another in said plurality of restraining slots of said plurality of slotted restraining plates with said power shafts, a plurality of channel roller bearings fastened to the side shafts portions of said plurality of connecting rods with said side shafts, a plurality of channel rollers fastened to, with channel roller bearings between, said side shaft portions of said plurality of connecting rods with said side shafts and fitted between said parallel protrusions that form said channel portions of said duality of engine housings with said channels, a plurality of channel bearings evenly disposed along the outward side of the channel portions of said duality of engine housings with said channels a plurality of threaded holes with fasteners for an assembly of the elements.

2. An engine of claim 1 having said duality of stationary engine housings with said channels, enclosing rotating elements excepting outward ends of power shafts, having said channel portions with said channel bearings disposed around an outward or inward side of its confines reducing resistance to the rolling motion of said channel rollers, attached to said side shaft portions of connecting rods with said side shafts and having said channel roller bearings disposed between said side shaft portions and said channel rollers, disposed within the confines of the channel portions, having said channel portions concentrically resisting inwardly forces applied to said channel rollers during combustion cycles forcing said channel rollers to roll within said channel portions alignment transitioning inward a stroke length, having said channel portions outwardly resisting motion of said channel rollers forcing said channel rollers to roll within said channel portions alignment transitioning outward a stroke length during exhaust cycles, having said channel portions inwardly resisting said channel rollers motion forming said channel rollers to roll within said channel portions alignment transitioning inward a stroke length during intake cycles, having said channel portions outwardly resisting said channel rollers motion forcing said channel rollers to roll within said channel portions alignment transitioning outward a stroke length during compression cycles and having an alignment of said channel portions prescribing a stroke length, degrees of rotation between cycles and number of cycles in each revolution, within practicalities of dimension and mechanics, best suiting chosen fuel.

3. An engine of claim 2 having said cylinder head, having the number of and location of exhaust and intake ports prescribed, in correspondence with degrees between and number of cycles in each revolution, by alignment of said duality of said channel portions of said engine housings with said channels.

4. An engine of claim 3 having said upper restraining ring, restraining in alignment said seal with compression rings to close said exhaust and intake ports in absence of said cylinder and providing a tighter seal of said cylinders during compression and combustion cycles prescribed by alignment of the channel portions of said duality of engine housings with said channels, restraining said plurality of cylinders in coplanar evenly radially disposed extended inwardly alignment for sequential entry into each of the cycles.

5. An engine of claim 4 having said plurality of cylinders, threaded at opposing ends, with said cylinders slightly greater in outside diameter for the length of the threads on the outward ends, fastened into said threaded openings in said upper restraining ring and fastened into threaded joined pairs of said threaded spacer bars at the inwardly ends, and providing a rigid coplanar radial coaxial connection between said upper restraining ring and said plurality of threaded-spacer bars.

6. An engine of claim 5 having said plurality of threaded spacer bars fastened between said plates portions of said slotted restraining plates with said power shafts at the perimeters of the plate portions, spacing said plate portions apart equal to the outside diameter of the inward end of said cylinders and spacing, and restraining said a plurality of cylinders in coplanar evenly radially disposed extended outwardly alignment for sequential entry into each of the cycles.

7. An engine of claim 6 having said restraining hub fastened between the inward centers of said opposing plate portions of said slotted restraining plates with power shafts, restraining plate portions spaced apart equal to outside diameter of inward ends of cylinders, and restraining inwardly ends of said connecting rods with said side shafts disposed in its receiving cylinders in coplanar radial reciprocating alignment.

8. An engine of claim 7 having said duality of slotted restraining plates with said power shafts, having said plate portions restraining, said restraining hub, said plurality of threaded spacer bars and said restraining slots in evenly spaced parallel plane coaxial radial alignment, and restraining said connecting rods with said side shafts portions placed through said restraining slots in rotating coplanar radial evenly spaced reciprocating alignment, and having said power shaft portions transmitting power out of enclosed portion of engine and providing an axes of rotation for said assemblage of single and multifunctional rotating elements.

9. The engine of claim 8 having said plurality of connecting rods with said side shafts fastened to said plurality of pistons, said plurality of channel roller bearings and said plurality of channel rollers, forcing said connecting rods with said side shafts, said pistons, said channel roller bearings and said channel rollers to reciprocate in unison, having said side shaft portions extended though said restraining slots restraining said connecting rods with said side shafts in rotating coplanar radial evenly spaced reciprocating alignment, having inwardly ends in said receiving cylinders restraining inwardly ends in rotating coplanar radial evenly spaced reciprocating alignment, transferring pressure of expanding combustion gases acting as an inward radial force on said pistons and attached connecting rods with side shafts during combustion cycles to said channel rollers constrained within said channel portions and said slots of slotted restraining plates with power shafts, transferring forces constraining said channel rollers to alignment of said channel portions to said pistons during exhaust, intake and compression cycles to said pistons.

* * * * *